US007163063B2

(12) United States Patent
Seams

(10) Patent No.: US 7,163,063 B2
(45) Date of Patent: Jan. 16, 2007

(54) METHOD AND SYSTEM FOR EXTRACTION OF RESOURCES FROM A SUBTERRANEAN WELL BORE

(75) Inventor: Douglas P. Seams, Calgary (CA)

(73) Assignee: CDX Gas, LLC, Dallas, TX (US)

( * ) Notice: Subject to any disclaimer, the term of this patent is extended or adjusted under 35 U.S.C. 154(b) by 168 days.

(21) Appl. No.: 10/723,322

(22) Filed: Nov. 26, 2003

(65) Prior Publication Data

US 2005/0109505 A1 May 26, 2005

(51) Int. Cl.
*E21B 43/18* (2006.01)

(52) U.S. Cl. ..... 166/370; 166/309; 299/2

(58) Field of Classification Search ..... 299/2; 166/305.1, 309, 370
See application file for complete search history.

(56) References Cited

U.S. PATENT DOCUMENTS

| | | | | |
|---|---|---|---|---|
| 54,144 | A | 4/1866 | Hamar | |
| 274,740 | A | 3/1883 | Douglass | |
| 526,708 | A | 10/1894 | Horton | |
| 639,036 | A | 12/1899 | Heald | |
| 1,189,560 | A | 7/1916 | Gondos | |
| 1,285,347 | A | 11/1918 | Otto | |
| 1,467,480 | A | 9/1923 | Hogue | |
| 1,485,615 | A | 3/1924 | Jones | |
| 1,488,106 | A | 3/1924 | Fitzpatrick | |
| 1,520,737 | A | 12/1924 | Wright | |
| 1,674,392 | A | 6/1928 | Flansburg | |
| 1,777,961 | A | 10/1930 | Capeliuschnicoff | |
| 2,018,285 | A | 10/1935 | Schweitzer et al. | 166/21 |
| 2,069,482 | A | 2/1937 | Seay | 255/76 |
| 2,150,228 | A | 3/1939 | Lamb | 166/10 |
| 2,169,718 | A | 8/1939 | Boll et al. | 255/24 |
| 2,335,085 | A | 11/1943 | Roberts | 251/197 |
| 2,450,223 | A | 9/1948 | Barbour | 255/76 |
| 2,490,350 | A | 12/1949 | Grable | 166/4 |

(Continued)

FOREIGN PATENT DOCUMENTS

CA 2 278 735 1/1998

(Continued)

OTHER PUBLICATIONS

Examiner of Record, Office Action Response regarding the Interpretation of the three Russian Patent Applications listed above under Foreign Patent Documents (9 pages), date unknown.

(Continued)

*Primary Examiner*—William Neuder
(74) *Attorney, Agent, or Firm*—Fish & Richardson P.C.

(57) ABSTRACT

A method for stimulating production of resources from a coal seam includes forming a drainage well bore in the coal bed that has a first end coupled to a ground surface and a second end in the coal seam. The method further includes inserting a liner into the well bore. The liner has a wall including a number of apertures and a second diameter that is smaller than the first diameter of the drainage well bore such that a gap is formed between the wall of the liner and the well bore. The method also includes collapsing the drainage well bore around the liner to relieve stress in the coal seam proximate to the liner.

90 Claims, 3 Drawing Sheets

U.S. PATENT DOCUMENTS

| | | | | |
|---|---|---|---|---|
| 2,679,903 | A | 6/1954 | McGowen, Jr. et al. | 166/1 |
| 2,726,063 | A | 12/1955 | Ragland et al. | 255/1.8 |
| 2,726,847 | A | 12/1955 | McCune et al. | 255/1.6 |
| 2,783,018 | A | 2/1957 | Lytle | 251/25 |
| 2,847,189 | A | 8/1958 | Shook | 255/76 |
| 2,911,008 | A | 11/1959 | Du Bois | 137/625.31 |
| 2,980,142 | A | 4/1961 | Turak | 137/637.3 |
| 3,208,537 | A | 9/1965 | Scarborough | 175/53 |
| 3,347,595 | A | 10/1967 | Dahms et al. | 299/4 |
| 3,443,648 | A | 5/1969 | Howard | 175/103 |
| 3,473,571 | A | 10/1969 | Dugay | 137/625.4 |
| 3,503,377 | A | 3/1970 | Beatenbough et al. | 123/117 |
| 3,528,516 | A | 9/1970 | Brown | 175/267 |
| 3,530,675 | A | 9/1970 | Turzillo | 61/35 |
| 3,684,041 | A | 8/1972 | Kammerer, Jr. et al. | 175/267 |
| 3,692,041 | A | 9/1972 | Bondi | 137/238 |
| 3,757,876 | A | 9/1973 | Pereau | 175/267 |
| 3,757,877 | A | 9/1973 | Leathers | 175/269 |
| 3,800,830 | A | 4/1974 | Etter | 137/625.41 |
| 3,809,519 | A | 5/1974 | Garner | 425/245 |
| 3,825,081 | A | 7/1974 | McMahon | 175/73 |
| 3,828,867 | A | 8/1974 | Elwood | 175/45 |
| 3,874,413 | A | 4/1975 | Valdez | 137/625.47 |
| 3,887,008 | A | 6/1975 | Canfield | 166/267 |
| 3,902,322 | A | 9/1975 | Watanabe | 61/35 |
| 3,907,045 | A | 9/1975 | Dahl et al. | 175/45 |
| 3,934,649 | A | 1/1976 | Pasini, III et al. | 166/254 |
| 3,957,082 | A | 5/1976 | Fuson et al. | 137/625.41 |
| 3,961,824 | A | 6/1976 | Van Eek et al. | 299/17 |
| 4,011,890 | A | 3/1977 | Andersson | 137/625.4 |
| 4,022,279 | A | 5/1977 | Driver | 166/271 |
| 4,037,658 | A | 7/1977 | Anderson | 166/272 |
| 4,073,351 | A | 2/1978 | Baum | 175/14 |
| 4,089,374 | A | 5/1978 | Terry | 166/259 |
| 4,116,012 | A | 9/1978 | Abe et al. | 405/238 |
| 4,134,463 | A | 1/1979 | Allen | 175/53 |
| 4,156,437 | A | 5/1979 | Chivens et al. | 137/554 |
| 4,169,510 | A | 10/1979 | Meigs | 175/65 |
| 4,189,184 | A | 2/1980 | Green | 299/8 |
| 4,194,580 | A | 3/1980 | Messenger | |
| 4,220,203 | A | 9/1980 | Steeman | 166/271 |
| 4,221,433 | A | 9/1980 | Jacoby | 299/4 |
| 4,224,989 | A | 9/1980 | Blount | 166/250 |
| 4,245,699 | A | 1/1981 | Steeman | |
| 4,257,650 | A | 3/1981 | Allen | 299/2 |
| 4,278,137 | A | 7/1981 | Van Eek | 175/267 |
| 4,283,088 | A | 8/1981 | Tabakov et al. | 299/2 |
| 4,296,785 | A | 10/1981 | Vitello et al. | 141/105 |
| 4,299,295 | A | 11/1981 | Gossard | 175/45 |
| 4,303,127 | A | 12/1981 | Freel et al. | 166/266 |
| 4,303,274 | A | 12/1981 | Thakur | |
| 4,305,464 | A | 12/1981 | Masszi | 166/370 |
| 4,312,377 | A | 1/1982 | Knecht | 137/625.19 |
| 4,317,492 | A | 3/1982 | Summers et al. | 175/79 |
| 4,328,577 | A | 5/1982 | Abbott et al. | 370/84 |
| 4,333,539 | A | 6/1982 | Lyons et al. | 175/61 |
| 4,366,988 | A | 1/1983 | Bodine | 299/14 |
| 4,372,398 | A | 2/1983 | Kuckes | 175/45 |
| 4,386,665 | A | 6/1983 | Dellinger | 175/61 |
| 4,390,067 | A | 6/1983 | Willman | 166/245 |
| 4,396,076 | A | 8/1983 | Inoue | 175/265 |
| 4,397,360 | A | 8/1983 | Schmidt | 175/61 |
| 4,401,171 | A | 8/1983 | Fuchs | 175/267 |
| 4,407,376 | A | 10/1983 | Inoue | 175/267 |
| 4,437,706 | A | 3/1984 | Johnson | 299/7 |
| 4,442,896 | A | 4/1984 | Reale et al. | 166/278 |
| 4,494,616 | A | 1/1985 | McKee | 175/67 |
| 4,512,422 | A | 4/1985 | Knisley | 175/99 |
| 4,519,463 | A | 5/1985 | Schuh | 175/61 |
| 4,527,639 | A | 7/1985 | Dickinson, III et al. | 175/61 |
| 4,532,986 | A | 8/1985 | Mims et al. | 166/50 |
| 4,544,037 | A | 10/1985 | Terry | 166/369 |
| 4,558,744 | A | 12/1985 | Gibb | 166/335 |
| 4,565,252 | A | 1/1986 | Campbell et al. | 175/269 |
| 4,573,541 | A | 3/1986 | Josse et al. | 175/78 |
| 4,599,172 | A | 7/1986 | Gardes | 210/314 |
| 4,600,061 | A | 7/1986 | Richards | 175/62 |
| 4,605,076 | A | 8/1986 | Goodhart | 175/61 |
| 4,611,855 | A | 9/1986 | Richards | 299/2 |
| 4,618,009 | A | 10/1986 | Carter et al. | 175/267 |
| 4,638,949 | A | 1/1987 | Mancel | 239/307 |
| 4,646,836 | A | 3/1987 | Goodhart | 166/303 |
| 4,651,836 | A | 3/1987 | Richards et al. | |
| 4,674,579 | A | 6/1987 | Geller et al. | 175/45 |
| 4,702,314 | A | 10/1987 | Huang et al. | 166/245 |
| 4,705,431 | A | 11/1987 | Gadelle et al. | 405/267 |
| 4,715,440 | A | 12/1987 | Boxell et al. | 166/100 |
| 4,754,819 | A | 7/1988 | Dellinger | 175/61 |
| 4,756,367 | A | 7/1988 | Puri et al. | 166/263 |
| 4,763,734 | A | 8/1988 | Dickinson et al. | 175/61 |
| 4,773,488 | A | 9/1988 | Bell et al. | 175/61 |
| 4,830,105 | A | 5/1989 | Petermann | 166/241 |
| 4,836,611 | A | 6/1989 | El-Saie | 299/7 |
| 4,842,081 | A | 6/1989 | Parant | 175/23 |
| 4,844,182 | A | 7/1989 | Tolle | 175/215 |
| 4,852,666 | A | 8/1989 | Brunet et al. | 175/61 |
| 4,883,122 | A | 11/1989 | Puri et al. | 166/248 |
| 4,929,348 | A | 5/1990 | Rice et al. | |
| 4,978,172 | A | 12/1990 | Schwoebel et al. | 299/12 |
| 5,016,710 | A | 5/1991 | Renard et al. | 166/245 |
| 5,035,605 | A | 7/1991 | Dinerman et al. | 481/18 |
| 5,036,921 | A | 8/1991 | Pittard et al. | 166/298 |
| 5,074,360 | A | 12/1991 | Guinn | 166/281 |
| 5,074,365 | A | 12/1991 | Kuckes | 175/40 |
| 5,074,366 | A | 12/1991 | Karlsson et al. | 175/76 |
| 5,082,054 | A | 1/1992 | Kiamanesh | 166/248 |
| 5,099,921 | A | 3/1992 | Puri et al. | |
| 5,111,893 | A | 5/1992 | Kvello-Aune | 175/258 |
| 5,135,058 | A | 8/1992 | Millgard et al. | 175/71 |
| 5,148,875 | A | 9/1992 | Karlsson et al. | 175/62 |
| 5,165,491 | A | 11/1992 | Wilson | 175/62 |
| 5,168,942 | A | 12/1992 | Wydrinski | 175/50 |
| 5,174,374 | A | 12/1992 | Hailey | 166/55.8 |
| 5,193,620 | A | 3/1993 | Braddick | 166/382 |
| 5,194,859 | A | 3/1993 | Warren | 340/853.4 |
| 5,197,553 | A | 3/1993 | Leturno | 175/57 |
| 5,197,783 | A | 3/1993 | Theimer et al. | 299/17 |
| 5,199,496 | A | 4/1993 | Redus et al. | 166/366 |
| 5,201,817 | A | 4/1993 | Hailey | 175/269 |
| 5,217,076 | A | 6/1993 | Masek | 166/303 |
| 5,240,350 | A | 8/1993 | Yamaguchi et al. | 405/143 |
| 5,242,017 | A | 9/1993 | Hailey | 166/55.8 |
| 5,242,025 | A | 9/1993 | Neill et al. | 175/26 |
| 5,246,273 | A | 9/1993 | Rosar | 299/4 |
| 5,255,741 | A | 10/1993 | Alexander | 166/278 |
| 5,271,472 | A | 12/1993 | Leturno | 175/107 |
| 5,289,881 | A | 3/1994 | Schuh | |
| 5,301,760 | A | 4/1994 | Graham | 175/61 |
| 5,363,927 | A | 11/1994 | Frank | 175/67 |
| 5,385,205 | A | 1/1995 | Hailey | 166/55.8 |
| 5,394,950 | A | 3/1995 | Gardes | 175/45 |
| 5,402,851 | A | 4/1995 | Baiton | 166/369 |
| 5,411,082 | A | 5/1995 | Kennedy | 166/181 |
| 5,411,085 | A | 5/1995 | Moore et al. | 166/242 |
| 5,411,088 | A | 5/1995 | LeBlanc et al. | 166/265 |
| 5,411,104 | A | 5/1995 | Stanley | 175/65 |
| 5,411,105 | A | 5/1995 | Gray | 175/69 |
| 5,419,396 | A | 5/1995 | Palmer et al. | |
| 5,431,220 | A | 7/1995 | Lennon et al. | 166/55.7 |
| 5,435,400 | A | 7/1995 | Smith | 175/61 |
| 5,447,416 | A | 9/1995 | Wittrisch | 417/442 |
| 5,450,902 | A | 9/1995 | Matthews | 166/268 |
| 5,454,419 | A | 10/1995 | Vloedman | 166/277 |
| 5,458,209 | A | 10/1995 | Hayes et al. | 175/61 |

| | | | | |
|---|---|---|---|---|
| 5,462,116 | A | 10/1995 | Carroll | 166/249 |
| 5,462,120 | A | 10/1995 | Gondouin | 166/380 |
| 5,469,155 | A | 11/1995 | Archambeault et al. | 340/853.4 |
| 5,477,923 | A | 12/1995 | Jordan, Jr. et al. | 66/313 |
| 5,485,089 | A | 1/1996 | Kuckes | 324/346 |
| 5,494,121 | A | 2/1996 | Nackerud | 175/263 |
| 5,499,687 | A | 3/1996 | Lee | 175/317 |
| 5,501,273 | A | 3/1996 | Puri | 166/252.5 |
| 5,501,279 | A | 3/1996 | Garg et al. | 166/372 |
| 5,562,159 | A | 10/1996 | Smith et al. | |
| 5,584,605 | A | 12/1996 | Beard et al. | 405/128 |
| 5,613,242 | A | 3/1997 | Oddo | 588/17 |
| 5,615,739 | A | 4/1997 | Dallas | 166/306 |
| 5,653,286 | A | 8/1997 | McCoy et al. | 166/105.5 |
| 5,655,605 | A * | 8/1997 | Matthews | 166/370 |
| 5,669,444 | A | 9/1997 | Riese et al. | 166/263 |
| 5,680,901 | A | 10/1997 | Gardes | 166/313 |
| 5,690,390 | A | 11/1997 | Bithell | 299/4 |
| 5,706,871 | A | 1/1998 | Anderson et al. | 141/59 |
| 5,720,356 | A | 2/1998 | Gardes | 175/62 |
| 5,727,629 | A | 3/1998 | Blizzard, Jr. et al. | 166/298 |
| 5,735,350 | A | 4/1998 | Longbottom et al. | 166/313 |
| 5,771,976 | A | 6/1998 | Talley | 166/370 |
| 5,775,433 | A | 7/1998 | Hammett et al. | 166/98 |
| 5,785,133 | A | 7/1998 | Murray et al. | 175/61 |
| 5,832,958 | A | 11/1998 | Cheng | 137/625.41 |
| 5,853,054 | A | 12/1998 | McGarian et al. | 175/267 |
| 5,853,056 | A | 12/1998 | Landers | 175/424 |
| 5,853,224 | A | 12/1998 | Riese | 299/13 |
| 5,863,283 | A | 1/1999 | Gardes | 588/250 |
| 5,868,202 | A | 2/1999 | Hsu | 166/256 |
| 5,868,210 | A | 2/1999 | Johnson et al. | 175/40 |
| 5,879,057 | A | 3/1999 | Schwoebel et al. | 299/17 |
| 5,884,704 | A | 3/1999 | Longbottom et al. | 16/313 |
| 5,917,325 | A | 6/1999 | Smith | 324/326 |
| 5,934,390 | A | 8/1999 | Uthe | 175/67 |
| 5,938,004 | A | 8/1999 | Roberts et al. | 198/812 |
| 5,941,308 | A | 8/1999 | Malone et al. | 166/313 |
| 5,957,539 | A | 9/1999 | Durup et al. | 299/4 |
| 5,971,074 | A | 10/1999 | Longbottom et al. | 166/313 |
| 6,012,520 | A | 1/2000 | Yu et al. | 166/245 |
| 6,015,012 | A | 1/2000 | Reddick | 166/313 |
| 6,024,171 | A | 2/2000 | Montgomery et al. | 166/308 |
| 6,050,335 | A | 4/2000 | Parsons | 166/272.3 |
| 6,056,059 | A | 5/2000 | Ohmer | 166/313 |
| 6,065,550 | A | 5/2000 | Gardes | 175/62 |
| 6,119,771 | A | 9/2000 | Gano et al. | 166/50 |
| 6,135,208 | A | 10/2000 | Gano et al. | 166/313 |
| 6,179,054 | B1 | 1/2001 | Stewart | 166/105.5 |
| 6,209,636 | B1 | 4/2001 | Roberts et al. | 166/117.6 |
| 6,280,000 | B1 | 8/2001 | Zupanick | 299/12 |
| 6,349,769 | B1 | 2/2002 | Ohmer | 166/313 |
| 6,357,523 | B1 | 3/2002 | Zupanick | 166/52 |
| 6,357,530 | B1 | 3/2002 | Kennedy et al. | 166/369 |
| 6,425,448 | B1 | 7/2002 | Zupanick et al. | 175/61 |
| 6,439,320 | B1 | 8/2002 | Zupanick | 166/313 |
| 6,450,256 | B1 | 9/2002 | Mones | 166/250.01 |
| 6,454,000 | B1 | 9/2002 | Zupanick | 166/243 |
| 6,457,540 | B1 | 10/2002 | Gardes | 175/62 |
| 6,478,085 | B1 | 11/2002 | Zupanick | 166/50 |
| 6,497,556 | B1 | 12/2002 | Zupanick | 417/85 |
| 6,561,288 | B1 | 5/2003 | Zupanick | 175/69 |
| 6,566,649 | B1 | 5/2003 | Mickael | 250/269.3 |
| 6,571,888 | B1 | 6/2003 | Comeau | 175/61 |
| 6,575,235 | B1 | 6/2003 | Zupanick | 166/50 |
| 6,577,129 | B1 | 6/2003 | Thompson | 324/338 |
| 6,585,061 | B1 | 7/2003 | Radzinski | 175/45 |
| 6,590,202 | B1 | 7/2003 | Mickael | 250/269.4 |
| 6,591,903 | B1 | 7/2003 | Ingle | 166/50 |
| 6,598,686 | B1 | 7/2003 | Zupanick | 175/62 |
| 6,604,580 | B1 | 8/2003 | Zupanick | 166/245 |
| 6,604,910 | B1 | 8/2003 | Zupanick | 417/36 |
| 6,607,042 | B1 | 8/2003 | Hoyer et al. | 175/38 |
| 6,636,159 | B1 | 10/2003 | Winnacker | 340/854.3 |
| 6,639,210 | B1 | 10/2003 | Odom et al. | 250/269.6 |
| 6,646,411 | B1 | 11/2003 | Hirono et al. | 324/338 |
| 6,646,441 | B1 | 11/2003 | Thompson et al. | |
| 6,653,839 | B1 | 11/2003 | Yuratich et al. | 324/355 |
| 6,662,870 | B1 | 12/2003 | Zupanick | 166/245 |
| 6,668,918 | B1 | 12/2003 | Zupanick | 166/50 |
| 6,679,322 | B1 | 1/2004 | Zupanick | 166/50 |
| 6,681,855 | B1 | 1/2004 | Zupanick | 166/50 |
| 6,688,388 | B1 | 2/2004 | Zupanick | 166/50 |
| 2001/0096336 | | 11/2001 | Zupanick | 175/161 |
| 2002/0050358 | A1 | 5/2002 | Algeroy | 166/313 |
| 2002/0074120 | A1 | 6/2002 | Scott | 166/313 |
| 2002/0074122 | A1 | 6/2002 | Kelly et al. | 166/313 |
| 2002/0108746 | A1 | 8/2002 | Zupanick | 166/50 |
| 2002/0117297 | A1 | 8/2002 | Zupanick | 166/50 |
| 2002/0189801 | A1 | 12/2002 | Zupanick | 166/50 |
| 2003/0062198 | A1 | 4/2003 | Gardes | 175/61 |
| 2003/0066686 | A1 | 4/2003 | Conn | 175/57 |
| 2003/0075334 | A1 | 4/2003 | Haugen et al. | 166/313 |
| 2003/0106686 | A1 | 6/2003 | Ingle et al. | 166/245 |
| 2004/0007389 | A1 | 1/2004 | Zupanick | 175/61 |
| 2004/0007390 | A1 | 1/2004 | Zupanick | 175/61 |

FOREIGN PATENT DOCUMENTS

| | | |
|---|---|---|
| DE | 653 741 | 1/1986 |
| EP | 0 875 661 A1 | 11/1998 |
| EP | 0 952 300 A1 | 10/1999 |
| GB | 2 255 033 | 10/1992 |
| GB | 2297 988 | 8/1996 |
| GB | 2347157 | 8/2002 |
| SU | 750108 | 6/1975 |
| SU | 1448078 A1 | 3/1987 |
| SU | 1770570 A1 | 3/1990 |
| WO | 94/21889 | 9/1994 |
| WO | WO 98/35133 | 8/1998 |
| WO | WO 99/60248 | 11/1999 |
| WO | 00/31376 | 6/2000 |
| WO | WO 00/79099 | 12/2000 |
| WO | WO 01/44620 | 6/2001 |
| WO | WO 01/51760 A2 | 7/2001 |
| WO | WO 01/51760 A3 | 7/2001 |
| WO | WO 02/18738 | 3/2002 |
| WO | WO 02/059455 | 8/2002 |
| WO | WO 03/0612383 | 8/2002 |
| WO | WO 03/102348 | 12/2003 |

OTHER PUBLICATIONS

McCray and Cole, "Oil Well Drilling and Technology," University of Oklahoma Press, pp. 315-319, 1959.

Berger and Anderson, "Modern Petroleum;" Penn Well Books, pp. 106-108, 1978.

Arfon H. Jones et al., A Review of the Physical and Mechanical Properties of Coal with Implications for Coal-Bed Methane Well Completion and Production, Rocky Mountain Association of Geologists, pp. 169-181, 1988.

Howard L. Hartman, et al.; "SME Mining Engineering Handbook;" Society for Mining, Metallurgy, and Exploration, Inc.; pp. 1946-1950, 2nd Edition, vol. 2, 1992.

Dave Hassan, Mike Chernichen, Earl Jensen, and Morley Frank; "Multi-lateral technique lowers drilling costs, provides environmental benefits", Drilling Technology, pp. 41-47, Oct. 1999.

Gopal Ramaswamy, "Production History Provides CBM Insights," Oil & Gas Journal, pp. 49, 50 and 52, Apr. 2, 2001.

Weiguo Chi and Luwu Yang, "Feasibility of Coalbed Methane Exploitation in China," Horizontal Well Technology, p. 74, Sep. 2001.

Nackerud Product Description, Harvest Tool Company, LLC, 1 page, received Sep. 27, 2001.

Gopal Ramaswamy, "Advanced Key for Coalbed Methane," The American Oil & Gas Reporter, pp. 71 & 73, Oct. 2001.

Joseph C. Stevens, Horizontal Applications For Coal Bed Methane Recovery, Strategic Research Institute, pp. 1-10 (slides), Mar. 25, 2002.
R.J. "Bob" Stayton, "Horizontal Wells Boost CBM Recovery", Special Report: Horizontal & Directional Drilling, The American Oil & Gas Reporter, pp. 71-75, Aug. 2002.
P. Jackson and S. Kershaw, Reducing Long Term Methane Emissions Resulting from Coal Mining, Energy Convers. Mgmt, vol. 37, Nos. 6-8, pp. 801-806, 1996.
Susan Eaton, "Reversal of Fortune", New Technology Magazine, pp. 30-31, Sep. 2002.
James Mahony, "A Shadow of Things to Come", New Technology Magazine, pp. 28-29, Sep. 2002.
Documents Received from Third Party, Great Lakes Directional Drilling, Inc., (12 pages), received Sep. 12, 2002.
Robert W. Taylor and Richard Russell, Multilateral Technologies Increase Operational Efficiencies in Middle East, Oil & Gas Journal, pp. 76-80, Mar. 16, 1998.
Adam Pasiczynk, "Evolution Simplifies Multilateral Wells", Directional Drilling, pp. 53-55, Jun. 2000.
Steven S. Bell, "Multilateral System with Full Re-Entry Access Installed", World Oil, p. 29, Jun. 1996.
Pascal Breant, "Des Puits Branches, Chez Total : les puits multi drains", Total Exploration Production, pp. 1-5, Jan. 1999.
Chi, Weiguo, "*A Feasible Discussion on Exploitation Coalbed Methane through Horizontal Network Drilling in China*", SPE 64709, Society of Petroleum Engineers (SPE International), 4 pages, Nov. 7, 2000.
Chi, Weiguo, "*Feasibility of Coalbed Methane Exploitation in China*", synopsis of paper SPE 64709, 1 page, Nov. 7, 2000.
Ian D. Palmer et al., "*Coalbed Methane Well Completions and Stimulations*", Chapter 14, pp. 303-339, Hydrocarbons from Coal, Published by the American Association of Petroleum Geologists, 1993.
Zupanick, U.S. Appl. No. 10/264,535, "Method and System for Removing Fluid From a Subterranean Zone Using an Enlarged Cavity", Aug. 15, 2003.
Notification of Transmittal of the International Search Report or the Declaration (PCT Rule 44.1) mailed Nov. 6, 2003 (8 pages) re International Application No. PCT/US 03/21626, Jul. 11, 2003.
Notification of Transmittal of the International Search Report or the Declaration (PCT Rule 44.1) mailed Nov. 5, 2003 (8 pages) re International Application No. PCT/US 03/21627, Jul. 11, 2003.
Notification of Transmittal of the International Search Report or the Declaration (PCT Rule 44.1) mailed Nov. 4, 2003 (7 pages) re International Application No. PCT/US 03/21628, Jul. 11, 2003.
Notification of Transmittal of the International Search Report or the Declaration (PCT Rule 44.1) mailed Dec. 5, 2003 (8 pages) re International Application No. PCT/US 03/21750, Jul. 11, 2003.
Notification of Transmittal of the International Search Report or the Declaration (PCT Rule 44.1) mailed Dec. 19, 2003 (8 pages) re International Application No. PCT/US 03/28137, Sep. 9, 2003.
Notification of Transmittal of the International Search Report or the Declaration (PCT Rule 44.1) mailed Feb. 4, 2004 (8 pages) re International Application No. PCT/US 03/26124, Sep. 9, 2003.
Smith, Maurice, "*Chasing Unconventional Gas Unconventionally*," CBM Gas Technology, New Technology Magazine, Oct./Nov. 2003, pp. 1-4.
Gardes, Robert "*A New Directional in Coalbed Methane and Shale Gas Recovery*," (to the best of Applicants' recollection, first received at The Canadian Institute Coalbed Methane Symposium conference on Jun. 16 and Jun. 17, 2002), 1 page of conference flyer, 6 pages of document.
Gardes, Robert, "*Under-Balance Multi-Lateral Drilling for Unconventional Gas Recovery*," (to the best of Applicants' recollection, first received at The Unconventional Gas Revolution conference on Dec. 9, 2003), 4 pages of conference flyer, 33 pages of document.
Boyce, Richard "*High Resolution Selsmic Imaging Programs for Coalbed Methane Development*," (to the best of Applicants' recollection, first received at The Unconventional Gas Revolution conference on Dec. 10, 2003), 4 pages of conference flyer, 24 pages of document.
Mark Mazzella and David Strickland, "*Well Control Operations on a Multiwell Platform Blowout*," WorldOil.com—Online Magazine Article, vol. 22, Part I—pp. 1-7, and Part II—pp. 1-13, Jan. 2002.
Vector Magnetics LLC, Case History, California, May 1999, "*Successful Kill of a Surface Blowout*," pp. 1-12, May 1999.
Cudd Pressure Control, Inc, "*Successful Well Control Operations-A Case Study: Surface and Subsurface Well Intervention on a Multi-Well Offshore Platform Blowout and Fire*," pp. 1-17, http://www.cuddwellcontrol.com/literature/successful/successful_well.htm, 2000.
R. Purl, et al., "*Damage to Coal Permeability During Hydraulic Fracturing*," pp. 109-115 (SPE 21813), 1991.
U.S. Dept. of Energy—Office of Fossil Energy, "*Multi-Seam Well Completion Technology: Implications for Powder River Basin Coalbed Methane Production*," pp. 1-100, A-1 through A10, Sep. 2003.
U.S. Dept. of Energy—Office of Fossil Energy, "*Powder River Basin Coalbed Methane Development and Produced Water Management Study*," pp. 1-111, A-1 through A14, Sep. 2003.
Zupanick, U.S. Patent Application, entitled "Method and Systems for Underground Treatment of Materials," U.S. Appl. No. 10/142,817, May 8, 2002.
Zupanick, U.S. Patent Application, entitled "Multi-Well Structure for Accessing Subterranean Deposits," U.S. Appl. No. 09/788,897, Feb. 20, 2001.
Zupanick, U.S. Patent Application, entitled "Slant Entry Well System and Method," U.S. Appl. No. 10/004,316, Oct. 30, 2001.
Zupanick, U.S. Patent Application, entitled "Undulating Well Bore", U.S. Appl. No. 10/194,366, Jul. 12, 2002.
Zupanick, U.S. Patent Application, entitled "Accelerated Production of Gas from a Subterranean Surface", U.S. Appl. No. 10/246,052, Sep. 17, 2002.
Zupanick, U.S. Patent Application, entitled "Ramping Well Bores", U.S. Appl. No. 10/194,367, Jul. 12, 2002.
Zupanick, U.S. Patent Application, entitled "System and Method for Subterranean Access", U.S. Appl. No. 10/227,057, Aug. 22, 2002.
Zupanick, U.S. Patent Application, entitled "Methods and System for Controlling Pressure in a Dual Well System", U.S. Appl. No. 10/244,082, Sep. 12, 2002.
Zupanick, U.S. Patent Application, entitled "Wellbore Sealing System and Method," U.S. Appl. No. 10/194,368, Jul. 12, 2002.
Zupanick, U.S. Patent Application, entitled "Wellbore Sealing System and Method," U.S. Appl. No. 10/194,422 PUBLISHED, Jul. 12, 2002.
Zupanick, U.S. Patent Application, entitled "Three-Dimensional Well System for Accessing Subterranean Zones," U.S. Appl. No. 10/244,083, Sep. 12, 2002.
Zupanick, U.S. Patent Application, entitled "Method of Drilling Lateral Wellbores from a Slant Well Without Utilizing a Whipstock", U.S. Appl. No. 10/267,426, Oct. 8, 2002.
Zupanick, U.S. Patent Application, entitled "Method and System for Circulating Fluid in a Well System", U.S. Appl. No. 10/323,192, Dec. 18, 2002.
Zupanick, U.S. Patent Application, entitled "Method and System for Removing Fluid from a Subterranean Zone Using and Enlarged Cavity", U.S. Appl. No. 10/264,535, Oct. 3, 2002.
Zupanick, U.S. Patent Application, entitled Method and System for Controlling the Production Rate . . . , U.S. Appl. No. 10/328,408, Dec. 23, 2002.
Rial, U.S. Patent Application, entitled Method and System for Accessing a Subterranean Zone from a Limited Surface Area, U.S. Appl. No. 10/188,141, Jul. 1, 2002.
Rial, U.S. Patent Application, entitled "Method and System for Recirculating Fluid in a Well System," U.S. Appl. No. 10/457,103, Jun. 5, 2003.
Zupanick, U.S. Patent Application, entitled "Wellbore Sealing System and Method," U.S. Appl. No. 10/406,037 Published, Jul. 12, 2002.
Notification of Transmittal of the International Search Report or the Declaration (PCT Rule 44.1) mailed Feb. 9, 2004 (6 pages) re International Application No. PCT/US 03/28138, Sep. 9, 2003.

Notification of Transmittal of the International Search Report or the Declaration (PCT Rule 44.1) mailed Feb. 27, 2004 (9 pages) re International Application No. PCT/US 03/30126, Sep. 23, 2003.
Fletcher, "Anadarko Cuts Gas Route Under Canadian River Gorge," Oil and Gas Journal, pp. 28-30, Jan. 25, 2004.
Translation of selected pages of Kalinin, et al., "Drilling Inclined and Horizontal Well Bores," Nedra Publishers, Moscow, 1997, 15 pages.
Translation of selected pages of Arens, V.Zh., "Well-Drilling Recovery of Minerals," Geotechnology, Nedra Publishers, Moscow, 7 pages, 1986.
William P. Diamond, "Methane Control for Underground Coal Mines," IC-9395, Bureau of Mines Information Circular, United States Department of the Interior, 1994 (51 pages).
Santos, Helio, SPE, Impact Engineering Solutions and Jesus Olaya, Ecopetrol/ICP, "*No-Damage Drilling: How to Achieve this Challenging Goal*?," SPE 77189, Copyright 2002, presented at the IADC/SPE Asia Pacific Drilling Technology, Jakarta, Indonesia, Sep. 9-11, 2002, 10 pages.
Santos, Helio, SPE, Impact Engineering Solutions, "*Increasing Leakoff Pressure with New Class of Drilling Fluid*," SPE 78243, Copyright 2002, presented at the SPE/ISRM Rock Mechanics Conference in Irving, Texas, Oct. 20-23, 2002, 7 pages.
Franck Labenski, Paul Reid, SPE, and Helio Santos, SPE, Impact Solutions Group, "*Drilling Fluids Approaches for Control of Wellbore Instability in Fractured Formations*," SPE/IADC 85304, Society of Petroleum Engineers, Copyright 2003, presented at the SPE/IADC Middle East Drilling Technology Conference & Exhibition in Abu Chabi, UAE, Oct. 20-22, 2003, 8 pages.
P. Reid, SPE, and H. Santos, SPE, Impact Solutions Group, "*Novel Drilling, Completion and Workover Fluids for Depleted Zones: Avoiding Losses, Formation Damage and Stuck Pipe*," SPE/IADC 85326, Society of Petroleum Engineers, Copyright 2003, presented at the SPE/IADC Middle East Drilling Conference & Exhibition on Abu Chabi, UAE, Oct. 20-22, 2003, 9 pages.
Craig C. White and Adrian P. Chesters, NAM; Catalin D. Ivan, Sven Maikranz and Rob Nouris, M-I L.L.C., "*Aphron-based drilling fluid: Novel technology for drilling depleted formations*," World Oil, Drilling Report Special Focus, Oct. 2003, 5 pages.
Robert E. Snyder, "*Drilling Advances*," World Oil, Oct. 2003, 1 page.
Notification of Transmittal of the International Search Report and the Written Opinion of the International Searching Authority, or the Declaration (3 pages), International Search Report (4 pages) and Written Opinion of the International Searching Authority (PCT Rule 43bis.1) (4 pages) re International Application No. PCT/US 2004/036920 mailed Feb. 24, 2005.
Molvar, Erik M., "Drilling Smarter: Using Directional Drilling to Reduce Oil and Gas Impacts in the Intermountain West," Prepared by Biodiversity Conservation Alliance, Report issued Feb. 18, 2003, 34 pages.
King, Robert F., "Drilling Sideways—A review of Horizontal Well Technology and Its Domestic Application," DOE/EIA-TR-0565, U.S. Department of Energy, Apr. 1993, 30 pages.
McLennan, John, et al., "Underbalanced Drilling Manual," Gas Research Institute, Chicago, Illinois, GRI Reference No. GRI-97/0236, copyright 1997, 502 pages.
David C. Oyler and William P. Diamond, "Drilling a Horizontal Coalbed Methane Drainage System From a Directional Surface Borehole," PB82221516, National Technical Information Service, Bureau of Mines, Pittsburgh, PA, Pittsburgh Research Center, Apr. 1982, 56 pages.
K&M Technology Group—Case Studies, "Improving Your Drilling Performance," Website: http://www.kmtechnology.com/projects/case_studies.asp, printed Mar. 17, 2005, 4 pages.
U.S. Environmental Protection Agency, "Directional Drilling Technology," prepared for the EPA by Advanced Resources International under Contract 68-W-00-094, Coalbed Methane Outreach Program (CMOP), Website: http://search.epa.gov/s97is.vts, printed Mar. 17, 2005, 13 pages.
Calendar of Events—Conferences, "Unconventional Gas: Key to Energy Supply," 6th Annual Unconventional Gas Conference, Calgary, Alberta, Canada, Website: http://www.csug.ca/cal/calc0401a.html, Nov. 17-19, 2004, 7 pages.
Information regarding San Juan 32-5 Unit, Well No. 100, completed on or about Sep. 1, 1989 (44 pages).
Information regarding Rosa Unit, Well No. 381, completed on or about Dec. 1, 2002 (25 pages).
Information regarding Rosa Unit, Well No. 379, completed on or about Sep. 1, 2002 (26 pages).
Information regarding Rosa Unit, Well No. 371, completed on or about Sep. 1, 2002 (30 pages).
Information regarding Rosa Unit, Well No. 273A, completed on or about Dec. 1, 2003 (19 pages).
Information regarding Vandewart B, Well No. 3S, completed on or about Aug. 1, 2004 (22 pages).
Information regarding Anderson, Well No. 1R, publication date believed to be Jun. 28, 2002-Sep. 5, 2002 (34 pages).
Information regarding Penrose, Well No. 1R, publication date believed to be Feb. 8, 2002-Jul. 18, 2003 (40 pages).
Information regarding Rosa Unit, Well No. 361, publication date believed to be Apr. 27, 2001-Aug. 12, 2002 (28 pages).
Information regarding Sunray H, Well No. 201, publication date believed to be Aug. 5, 1988-May 2, 1989 (21 pages).
Seams, U.S. Patent Application entitled, "System and Method for Enhancing Permeability of a Subterranean Zone at a Horizontal Well Bore," U.S. Appl. No. 11/035,537, filed Jan. 14, 2005 (27 pages).
Zupanick, U.S. Patent Application entitled, "Accessing Subterranean Resources by Formation Collapse," U.S. Appl. No. 11/019,757, filed Dec. 21, 2004 (41 pages).
Notification of Transmittal of International Preliminary Examination Report (6 pages) mailed Jan. 18, 2005 and Written Opinion (8 pages) mailed Aug. 25, 2004 for International Application No. PCT/US03/30126.
Pratt et al., U.S. Patent Application entitled, "Drilling Normally to Sub-Normally Pressured Formations," U.S. Appl. No. 11/141,459, filed May 31, 2005.
Oil and Gas Information Database Project Workshop Notes, Mar. 8, 2005, 14 pages.
P. Reid, H. Santos and F. Labenski, "*Associative Polymers for Invasion Control in Water-and Oil-based Muds and in Cementing Spacers: Laboratory and Field Case Histories,*" American Association of Drilling Engineers, AADE-04-DF-HO-33, prepared for presentation at the AADE 2004 Drilling Fluids Conference, Apr. 6-7, 2004, 14 pages.
Notification of Transmittal of the International Search Report and the Written Opinion of the International Searching Authority, or the Declaration (2 pages), International Search Report (3 pages), and Written Opinion of the International Searching Authority (7 pages) for International Application No. PCT/US2006/001403 mailed May 19, 2006.

* cited by examiner

METHOD AND SYSTEM FOR EXTRACTION OF RESOURCES FROM A SUBTERRANEAN WELL BORE

TECHNICAL FIELD OF THE INVENTION

The present invention relates generally to recovery of subterranean resources and more particularly to a method and system extraction of resources from a subterranean well bore.

BACKGROUND OF THE INVENTION

Subterranean deposits of coal, also referred to as coal beds, contain substantial quantities of entrained resources, such as natural gas (including methane gas or any other naturally occurring gases). Production and use of natural gas from coal deposits has occurred for many years. However, substantial obstacles have frustrated more extensive development and use of natural gas deposits in coal beds.

SUMMARY OF THE INVENTION

According to one embodiment of the invention, a method for extracting resources from a subterranean coal bed is provided. The method includes forming a drainage well bore in the coal bed. The well bore has a first end at a ground surface and a second end in the coal bed. The method also includes inserting a tube into the second end of the drainage well bore. The method also includes generating a flow of fluid from the second end to the first end by injecting fluid into the second end through the tube. The method also includes collecting, at the first end, a mixture comprising the fluid, a plurality of coal fines, and any resource from the well bore that is mixed with the fluid.

According to another embodiment, a method for stimulating production of resources from a coal seam includes forming a drainage well bore in the coal bed that has a first end coupled to a ground surface and a second end in the coal bed. The method further includes inserting a liner into the well bore. The liner has a wall including a number of apertures and a second diameter that is smaller than the first diameter of the drainage well bore such that a gap is formed between the wall of the liner and the well bore. The method also includes collapsing the drainage well bore around the liner to relieve stress in the coal seam proximate to the liner.

Some embodiments of the invention provide numerous technical advantages. Some embodiments may benefit from some, none, or all of these advantages. For example, according to certain embodiments, resource production from a well bore is improved by an efficient removal of water and obstructive material. In particular embodiments, such water and obstructive material may be moved without the use of a down hole pump.

Furthermore, in certain embodiments, efficiency of gas production may be improved in a coal beds by increasing the permeability of parts of the coal by providing controlled collapse of a portion of the coal or other forms of stress relief in portions of the coal. Such stress relief may be particularly useful in low permeability, high gas content coal beds and can stimulate production in such coal beds. In addition, in particular embodiments, a drainage well bore having a flatter curvature may be used to efficiently produce resources by angling the drainage well bore downward relative to the horizontal in the coal seam.

Other technical advantages will be readily apparent to one skilled in the art.

BRIEF DESCRIPTION OF THE DRAWINGS

Reference is now made to the following description taken in conjunction with the accompanying drawings, wherein like reference numbers represent like parts, in which.

DETAILED DESCRIPTION

Figure 1:
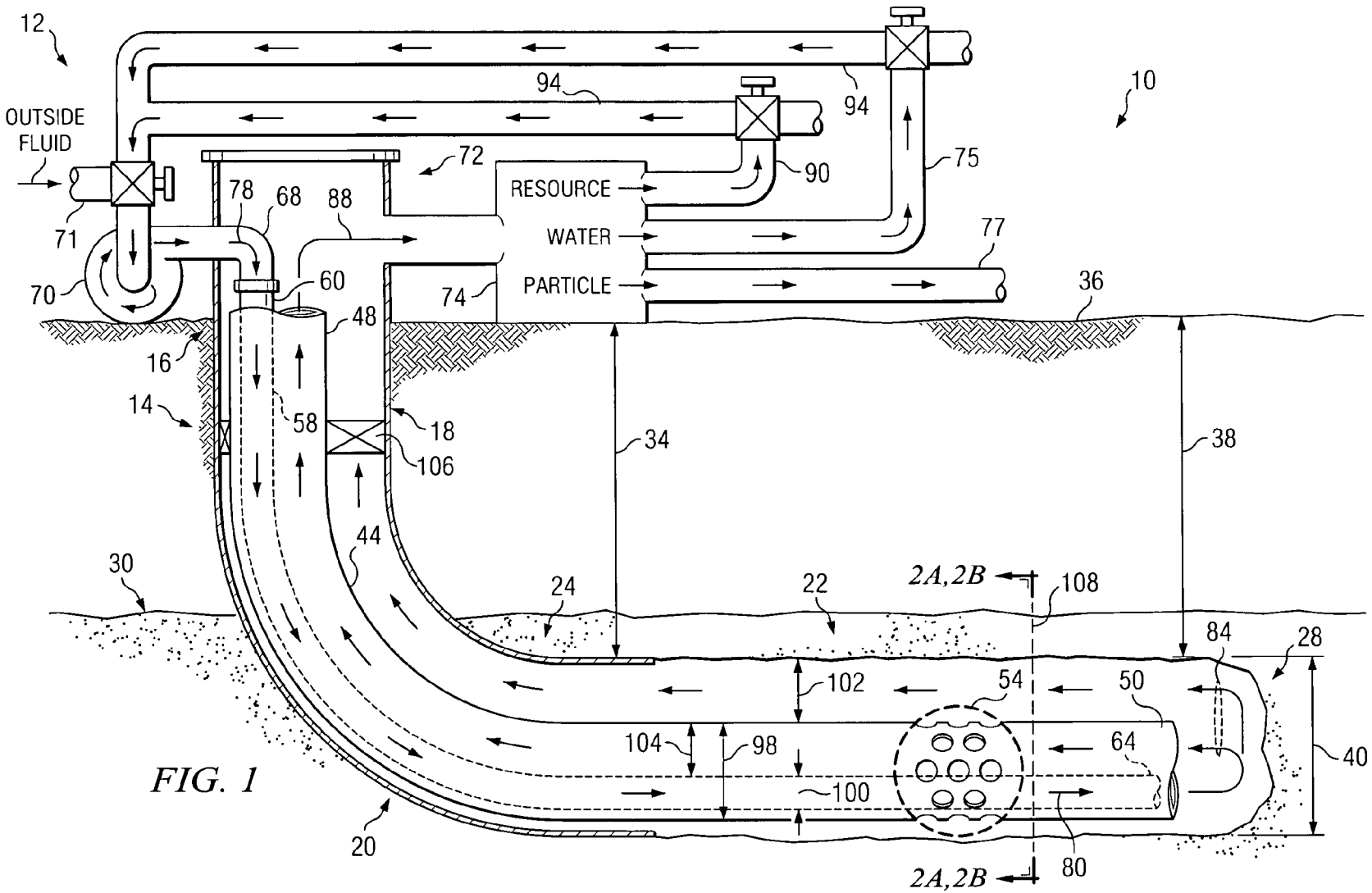
FIG. 1 is a schematic diagram illustrating one embodiment of a resource extraction system constructed in accordance with one embodiment of the present invention.
Figure 2A:
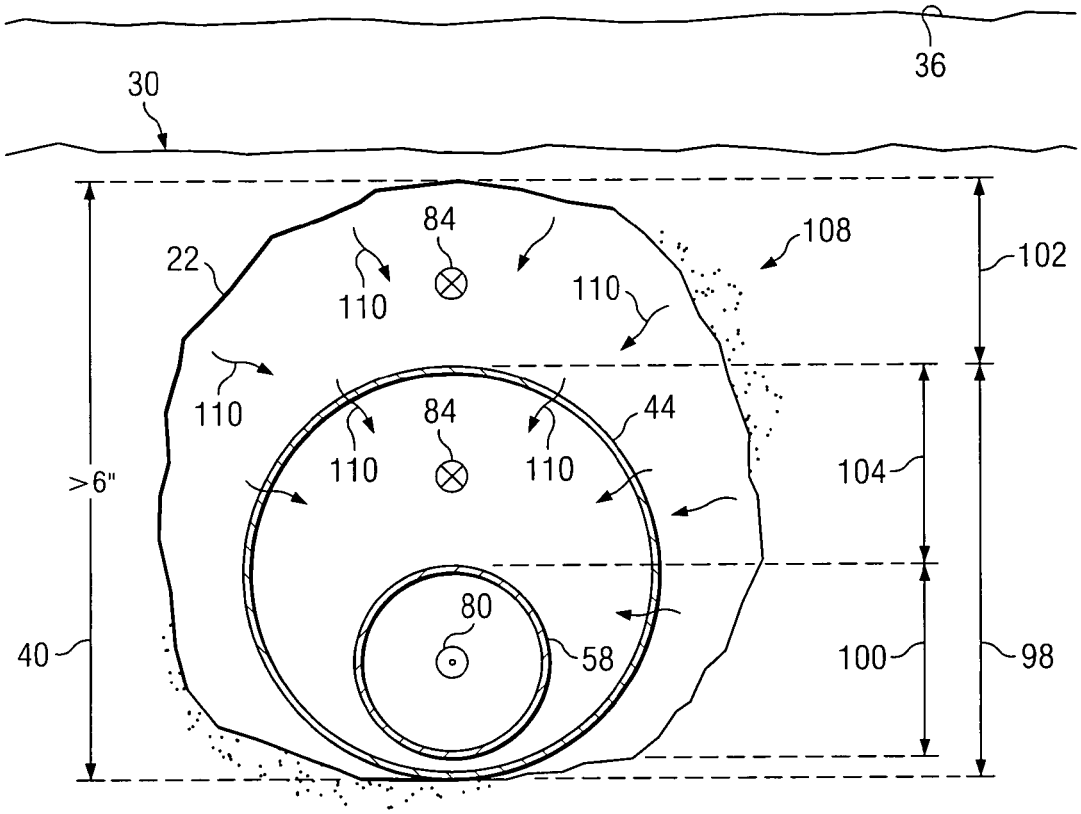
FIG. 2A is a cross sectional diagram illustrating one embodiment of a liner and a tube in a well bore shown in FIG. 1.
Figure 2B:
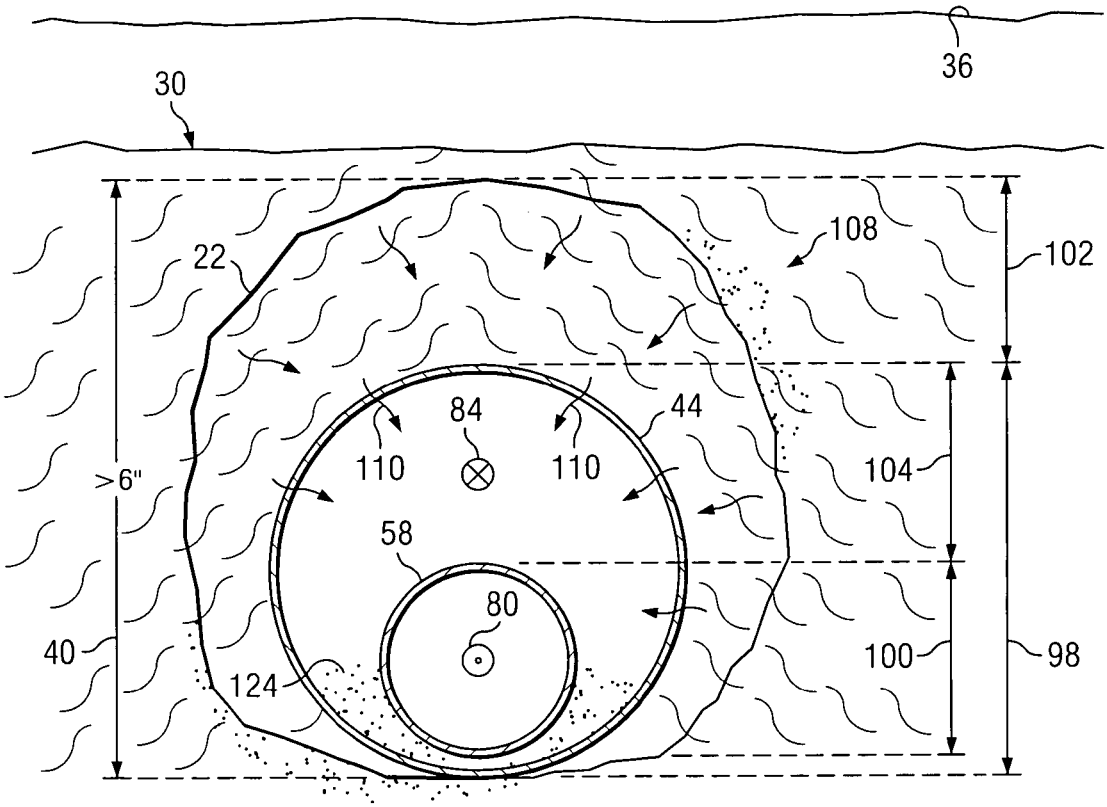
FIG. 2B is a cross sectional diagram illustrating one embodiment of the liner and the tube positioned in the well bore of FIG. 2A after a collapse of the well bore.
Figure 3:
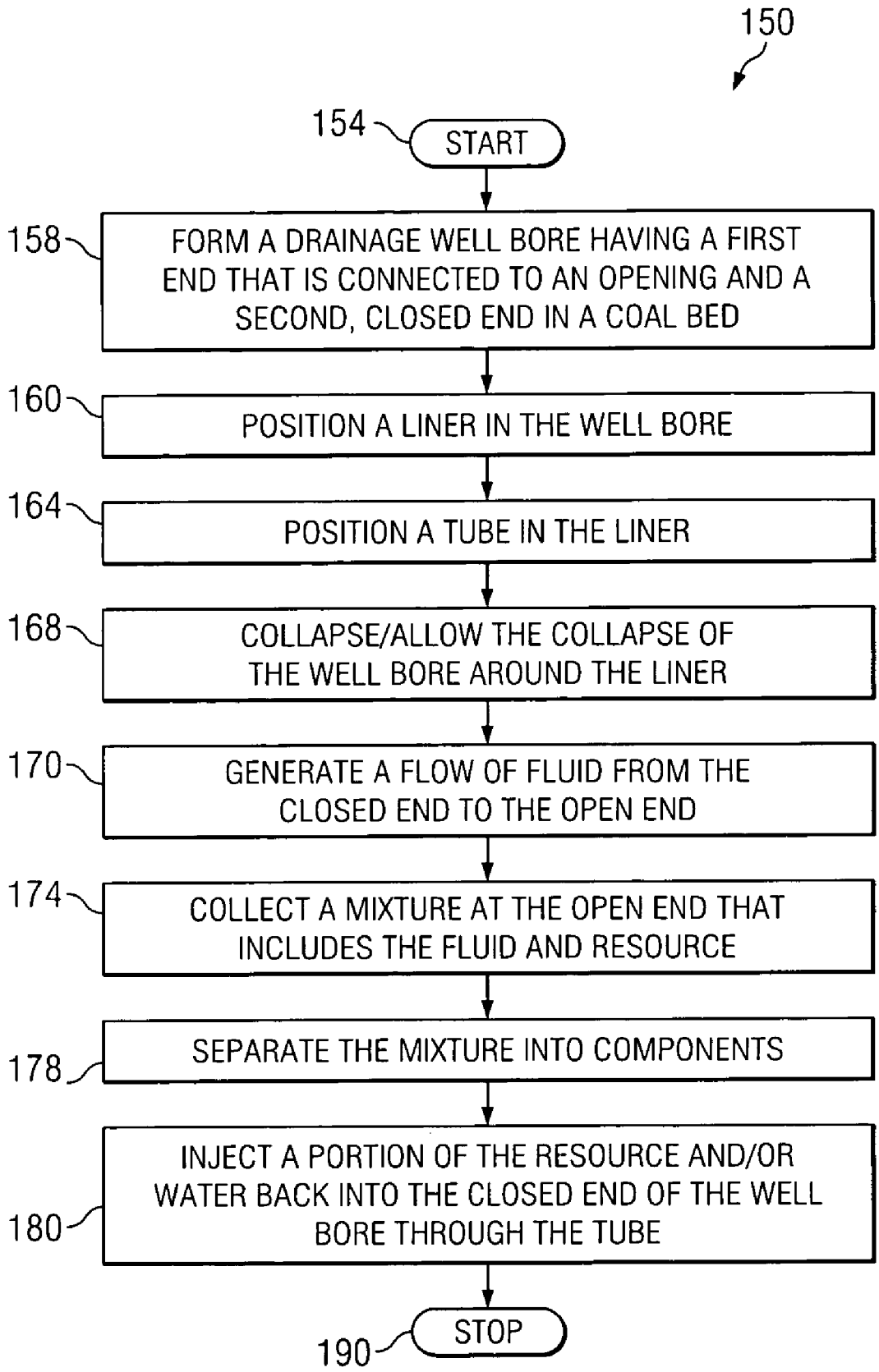
FIG. 3 is a flow chart illustrating one embodiment of a method for extraction of resources from the well bore of FIG. 1.

Embodiments of the invention are best understood by referring to FIGS. 1 through 3 of the drawings, like numerals being used for like and corresponding parts of the various drawings.

FIG. 1 is a schematic diagram illustrating one embodiment of a well system 10. Well system 10 includes a resource extraction system 12 positioned on a ground surface 36 and a drainage well bore 14 that extends below ground surface 36. Drainage well bore 14 includes an open end 16, a substantially vertical portion 18, an articulated potion 20, and a drainage portion 22. Any one of portions 18, 20, and 22 of well bore 14 may individually constitute a well bore, and may be referred to as a well bore herein. Drainage portion 22 of well bore 14 includes a first end 24 and a second end 28. As shown in FIG. 1, first end 24 of drainage portion 22 is accessible from a location above ground surface 36, such as open end 16. In one embodiment, second end 28 of drainage portion 22 may be a closed end that is not accessible from a location above ground surface, except through first end 24 of drainage portion 22, as shown in FIG. 1. As used herein, second end 28 is also referred to as a closed end 28. Second end 28 also constitutes an end 28 of drainage well bore 14. Drainage portion 22 of well bore 14 may be positioned at least partly in a coal bed 30 or any other appropriate subterranean zone that includes resources to be extracted.

Drainage well bore 14 may be drilled using an articulated drill string that includes a suitable down hole motor and a drill bit. A measurement while drilling ("MWD") device may be included in articulated drill string for controlling the orientation and direction of the well bore drilled by the motor and the drill bit.

As shown in FIG. 1, drainage portion 22 is approximately horizontal. In one embodiment where ground surface 36 is substantially horizontal, a distance 34 from ground surface 36 to end 24 is approximately equal to a distance 38 between ground surface 36 and end 28. However, portion 22 is not required to be horizontal. For example, where well bore 14 is a down-dip or an up-dip well bore, portion 22 may be sloped. In a down-dip configuration, distance 38 may be greater than distance 34, which allows articulated portion 20 to be less curved. This is advantageous because a less extreme curvature at portion 20 allows the overall length of well bore 14 to be greater, which improves efficiency of resource production. Because a flow of fluid is generated from end 28 of portion 22 to move the gas in portion 22 to ground surface 36, production inefficiencies conventionally associated with a down-dip well bore is reduced. In one embodiment, drainage portion 22 may be approximately horizontal with respect to coal bed 30, regardless of whether coal bed 30 is parallel to ground surface 36. In one embodiment, portion 22 may be angled with respect to coal bed 30 rather than ground surface 36.

Production of resources, such as natural gas, may be dependent on the level of resource content in coal bed 30 and permeability of coal bed 30. Gas is used herein as an example resource available from a coal region, such as coal bed 30; however, the teachings of the present invention may be applicable to any resource available from a subterranean zone that may be extracted using a well bore. In general, less restricted movement of gas within coal bed 30 allows more gas to move into well bore 14, which allows more gas to be removed from well bore 14. Thus, a coal bed having low permeability often results in inefficient resource production because the low number and/or low width of the cleats in coal bed 30 limit the movement of gas into well bore 14. In contrast, high permeability results in a more efficient resource production because the higher number of pores allow freer movement of gas into well bore 14.

Conventionally, a well bore is drilled to reach a coal bed that includes resources, such as natural gas. Once a well bore is formed, a mixture of resources, water, and coal fines may be forced out of the coal bed through the well bore because of the pressure difference between the ground surface and the coal bed. After collecting the mixture at the ground surface, the resource is separated from the mixture. However, production of resources from a well bore in such a manner may be inefficient for numerous reasons. For example, the level of resource production may be reduced due to the coal fines that may obstruct the well bore or a possible collapse of the well bore. A well bore in a coal bed having low permeability or under lower pressure may produce a lower level of resources. Additionally, a "down dip" well bore, which refers to an articulated well bore having a flatter curvature and a portion that slopes downward from the horizontal, may produce a lower level of resources due to a higher producing bottom hole pressure resulting from the hydrostatic pressure of the water collecting up to the pumping point.

According to some embodiments of the present invention, a method and a system for extracting resources from a subterranean well bore are provided. In certain embodiments, efficiency of gas production may be improved in a coal beds by increasing the permeability of parts of the coal by providing controlled collapse of a portion of the coal or other forms of stress relief in portions of the coal. Such stress relief may be particularly useful in low permeability, high gas content coal beds and can stimulate production in such coal beds. In particular embodiments, a drainage well bore having a flatter curvature may be used to efficiently produce resources. Additional details of example embodiments of the methods and the systems are provided below in conjunction with FIGS. 1 through 3.

Referring back to FIG. 1, resource extraction system 12 is provided for gas production from drainage well bore 14. System 12 includes a liner 44, a tube 58, a fluid injector 70 (which may inject gas, liquid, or foam), a well head housing 68, and a separator 74. Liner 44 has a first end 48 and a second end 50. Tube 58 has an entry end 60 and an exit end 64. Fluid injector 70 is coupled to entry end 60 of tube 58 through outlet 68. Housing 72 is coupled to separator 74 and is operable to direct any material from well bore 14 into separator 74. Separator 74 is coupled to fluid injector 70 through a pipe 94.

Fluid injector 70 is operable to urge an injection fluid out through outlet 68. An example of fluid injector 70 is a pump or a compressor. Any suitable type of injection fluid may be used in conjunction with fluid injector 70. Examples of injection fluid may include the following: (1) production gas, such as natural gas, (2) water, (3) air, and (4) any combination of production gas, water, air and/or treating foam. In particular embodiments, production gas, water, air, or any combination of these may be provided from an outside source through a tube 71. In other embodiments, gas received from well bore 14 at separator 74 may be provided to injector 70 through tubes 90 and 94 for use as an injection fluid. In another embodiment, water received from well bore 14 at separator 74 may be provided to injector 70 through tubes 75 and 94 for use as an injection fluid. Thus, the fluid may be provided to injector 70 from an outside source and/or separator 74 that may recirculate fluid back to injector 70.

Separator 74 is operable to separate the gas, the water, and the particles and lets them be dealt with separately. Although the term "separation" is used, it should be understood that complete separation may not occur. For example, "separated" water may still include a small amount of particles. Once separated, the produced gas may be removed via outlet 90 for further treatment (if appropriate). In one embodiment, a portion of the produced gas may be provided to injector 70 via tube 94 for injection back into well bore 14. The particles, such as coal fines, may be removed for disposal via an outlet 77 and the water may be removed via an outlet 75. Although a single separator 74 is shown, the gas may be separated from the water in one apparatus and the particles may be separated from the water in another apparatus. Furthermore, although a separation tank is shown, one skilled in the art will appreciate numerous different separation devices may be used and are encompassed within the scope of the present invention.

As shown as FIG. 1, in particular embodiments, second end 50 of liner 44 is located approximately at closed end 28 of well bore 14. End 48 of liner 44 is approximately at opening 16 of well bore 14; however, end 48 may be anywhere along vertical portion 18 or articulated portion 20 of well bore 14. In certain embodiments, liner 44 may be omitted. In particular embodiments, the wall of liner 44 may include a plurality of apertures 54. Apertures 54 may include holes, slots, or openings of any other shape. In particular embodiments, the use of holes as the apertures may allow production of more coal fines than the use of slots, while the use of slots may provide more alignment of the apertures with cleats in the coal than when using holes. Although apertures in a portion of the liner 44 are illustrated, apertures may be included in any appropriate portion of the length of liner 44. The size of apertures 54 may be adjusted depending on the size of coal particles or other solids that are desired to be kept outside of liner 44. For example, if it is determined that a piece of coal having a diameter greater than one inch should not be inside liner 44, then each aperture 54 may have a diameter of less than one inch. In particular example embodiments, apertures 54 may be holes having a diameter of between 1/16 and 1.5 inches or slots having a width of between 1/32 and 1/2 inches (although any other appropriate diameter or width may be used).

Tube 58 is positioned inside well bore 14. In embodiments where liner 44 is used, tube is positioned inside liner 44. As shown in FIG. 1, in one embodiment, exit end 64 is positioned approximately at closed end 28 of well bore 14. Entry end 60 is positioned approximately at open end 16 of well bore 14. In one embodiment, coil tubing may be used as tube 58; however, any suitable tubing may be used as tube 58 (for example, jointed pipe).

In operation, a well bore, such as well bore 14, is formed in coal bed 30. In particular embodiments, well bore 14 is formed without forming a secondary well bore that intersects portion 22; however, a secondary well bore may be formed in other embodiments. Fluid injector 70 injects an injection fluid, such as water or natural gas, into entry end 60 of tube 58, as shown by an arrow 78. The injection fluid travels through tube 58 and is injected into closed end 28, as shown by an arrow 80. Because end 28 is closed, a flow of injection fluid is generated from end 28 to end 24 of portion 22 through gaps 104 and/or 102, as shown by arrows 84. In particular embodiments gap 104 may be blocked by a plug, packer, or valve 106 (or other suitable device) to prevent flow of fluid to the surface via gap 104 (which may be inefficient). In other embodiments, gap 104 may be removed due to the collapse of the coal against liner 44, as described in further detail below.

As the injection fluid flows through gaps 102 and 104, the injection fluid mixes with water, coal fines, and resources, such as natural gas, that move into well bore 14 from coal bed 30. Thus, the flow of injection fluid removes water and coal fines in conjunction with the resources. The mixture of injection fluid, water, coal fines, and resources is collected at separator 74, as shown by arrow 88. Then separator 74 separates the resource from the injection fluid carrying the resource. Although the injection fluid may be used for some time to remove fluids from well bore 14, at some point (such as during the mid-life or late-life of the well) a pump may replace the use of the injection fluid to remove fluids from the well bore 14 in certain embodiments. The "mid-life" of the well may be the period during which well 14 transitions from high fine production to a much lower fine production. During this period, the coal may substantially stabilize around liner 44. In other embodiments, a pump may be used for the entire life of the well, although in such embodiments the particles in the well may not be swept out (or the extent of their removal may be diminished).

In one embodiment, the separated resource from separator 74 is sent to fluid injector 70 through tube 94 and injected back into entry end 60 of tube 58 to continue the flow of fluid from end 28 to ends 24 and 16. In another embodiment, liquid, such as water, may be injected into end 28 using fluid injector 70 and tube 58. Because liquid has a higher viscosity than air, liquid may pick up any potential obstructive material, such as coal fines in well bore 14, and remove such obstructive material from well bore 14. In another embodiment, air may be injected into end 28 using fluid injector 70 and tube 58. In one embodiment, any combination of air, water, and/or gas that are provided from an outside source and/or recirculated from separator 74 may be injected back into entry end 60 of tube 58.

Respective cross sectional diameters 98 and 100 of liner 44 and tube 58 are such that gaps 102 and 104 are formed. As shown in FIG. 1, the difference between diameter 40 and diameter 98 results in a formation of gap 102. The difference between diameter 98 and diameter 100 results in a formation of gap 104. The larger the gap, the more stress relief (and depth of penetration of the stress relief) that is provided in the coal. The size of gaps 102 and 104 may be controlled by adjusting diameters 40, 98, and 100. For example, portion 22 of well bore 14 may be formed so that diameter 44 is substantially larger than diameter 98 of liner 44. However, a smaller diameter 40 may be used where diameter 98 of liner 44 is smaller. Analogously, diameters 98 and 100 may be selected depending on the size of gap 104 that is desired. In one embodiment, diameter 98 is less than 4.5 inches; however, diameter 98 may be any suitable length. In one embodiment, diameter 100 is less than 2.5 inches; however, diameter 100 may be any suitable length. Diameter 98 may have any appropriate proportion with respect to diameter 40 to allow the desired amount of collapse. In particular embodiments, diameter 98 is less than approximately ninety percent of diameter 40. However, in other embodiments, diameter 98 may be very close to diameter 40 such that the coal is allowed to slightly expand against the liner (to relief stress) but does not disintegrate. Such an expansion of the coal shall be included in the meaning of the term "collapse" or it variants.

Diameter 40 of portion 22 may be selected depending on the particular characteristics of coal beds 30. For example, where coal bed 30 has low permeability, diameter 40 of portion 22 may be larger for better resource production. Where coal bed 30 has high permeability, diameter 40 may be smaller. In particular embodiments, diameter 40 of portion 22 may be sufficiently large to allow portion 22 to collapse around liner 44. In one embodiment, diameter 40 of well bore 14 may be greater than six inches. In another embodiment, diameter 40 may be between approximately five to eight inches. In another embodiment, diameter 40 may be greater than 10 inches.

A collapse of well bore 14 around liner 44 may be advantageous in some embodiments because such a collapse increases the permeability of the portion of coal bed 30 immediately around liner 44, which allows more gas to move into portion 22 and thus improves the efficiency of resource production. This increase in permeability is due, at least in part, to the stress relief in the coal due to the collapse. The effects of this stress relief may extend many feet from well bore 14 (for example, in certain embodiments, up to fifty feet).

Furthermore, since the well bore 14 is allowed to collapse, the well bore 14 may be drilled in an "overbalanced" condition to prevent collapse during drilling without adversely affecting the flow capacity of well bore 14. Although overbalanced drilling does force drilling fluids (such as drilling mud) and fines into the coal bed during drilling (which in some cases can reduce subsequent production from the coal), the "cake" formed around the wall of well bore 14 by the drilling fluid and fines deposited on the wall may be formed in a manner that is advantageous. More specifically, a thin cake may be formed by using a low-loss drilling fluid that minimizes fluid loss into the coal formation (for example, an invasion of drilling fluid and/or fines less than six inches into the coal seam may be preferable). Furthermore, the drilling may be performed and a type drilling fluid may be used such that the cake builds up quickly and remains intact during drilling. This may have the added advantage of supporting the coal to prevent its collapse before and while liner 44 is inserted.

In one embodiment, liner 44 is positioned in portion 22 without providing any support to prevent a collapse of portion 22, which increases the probability of well bore collapse. In such an embodiment, the probability of well bore collapse may be increased by drilling a well bore having a larger diameter than liner 44 and lowering the bottom hole pressure. Thus the coal may be collapsed onto the liner 44 by lowering the bottom hole pressure below a threshold at which the coal collapses. For example, the drilling fluid may be left in well bore 14 while liner 44 is inserted (to help prevent collapse), and then the drilling fluid (and possibly other fluids from the coal) may be pumped or gas lifted to the surface to instigate a collapse of the coal.

The collapse may occur before or after production begins. The bottom hole pressure may be reduced either quickly or slowly, depending, among other things, on the type of coal and whether the coal is to be collapsed or only expanded against liner 44.

In other embodiments, collapse of well bore 14 may instigated using any suitable methods, such as a transmission of shock waves to coal bed 30 using a seismic device or a controlled explosion. Allowing a collapse of or collapsing well bore 14 may be beneficial in situations where coal bed 30 has low permeability; however, coal bed 30 having other levels of permeability may also benefit from the collapse of portion 22.

FIG. 2A is a cross sectional diagram illustrating one embodiment of liner 44 and tube 58 in well bore 14 at a location and orientation indicated by a reference number 108 in FIG. 1. As shown in FIG. 2A, injection fluid from fluid injector 70 flows in the direction indicated by arrow 80 (pointing towards the viewer). Because end 28 is closed, injection fluid is returned back to end 24 in a direction indicated by arrows 84 (pointing away from the viewer) through gaps 102 and/or 104. The flow of injection fluid in the direction indicated by arrow 84 creates a mixture of injection fluid, gas (resources), water, and coal fines that move into well bore 14 (as indicated by arrows 110). The mixture moves to separator 74 through opening 16.

FIG. 2B is a cross sectional view of liner 44 and tube 58 in a collapsed well bore 14 at a location and orientation indicated by a reference number 108 in FIG. 1. As shown in FIG. 2B, in one embodiment, well bore 14 is allowed to close gap 102 by collapsing around liner 44 to increase the permeability of coal bed 30 immediately around liner 44 by relieving stress in the coal. Further, permeability may be increased through matrix shrinkage that occurs during the degassing of high gas content coals in coal bed 30. Thus, more gas moves from coal bed 30 into the space defined by liner 44 through apertures 54 of liner 44. Gas is then removed from well bore 14 using flow of fluid in the direction indicated by arrow 84 through gap 104. In one embodiment where liquid or other injection fluid having a viscosity level higher than that of natural gas or air is periodically injected into closed end 28 through tube 58, any coal fines 124 that may not have been removed before may be removed by the flow of injection liquid in direction 84.

FIG. 3 is a flow chart illustrating one embodiment of a method 150 for removal of resources from well bore 14. Some or all acts associated with method 150 may be performed using system 12. Method 150 starts at step 154. At step 158, drainage well bore 14 having a drainage portion 22 is formed in coal bed 30. At step 160, liner 44 is positioned in well bore 22. In particular embodiments, step 160 may be omitted. At step 164, tube 58 is positioned in well bore 14. In embodiments where liner 44 is used, tube 58 is positioned within liner 44.

In embodiments where liner 44 is position in well bore 22 at step 160, well bore 22 may be allowed to collapse around liner 44 at step 168. In one embodiment, the collapse of well bore 22 may be instigated using any suitable method, such as a seismic device or a controlled explosion. At step 170, a flow of injection fluid is generated from end 28 to end 24. In one embodiment, the flow may be generated by injecting injection fluid into closed end 28 of well bore 22 through tube 58; however, any other suitable methods may be used. The injection fluid may be any suitable gas or liquid. At step 174, a mixture that includes the injection fluid, resource, and water and/or coal fines is collected at the open end. At step 178, the mixture is separated into different components. In one embodiment, at step 180, a portion of the separated resource and/or water is injected back into closed end 28 of well bore 22 through tube 58. Alternatively, at step 180, injection fluid from an outside source may be injected back into closed end 28 of well bore 22 through tube 58 to continue the fluid flow. Steps 170 and/or 180 may be continuously performed to continue the fluid flow in well bore 22. Step 180 may be omitted in some embodiments. Method 150 stops at step 190.

In one embodiment, the injection fluid used to generate a flow of fluid may be natural gas or air. In one embodiment, the injection fluid may be liquid, such as water. Using liquid may be advantageous in some embodiments because liquid may be a better medium for coal fine removal.

Although embodiments of the present invention are only illustrated as being used in well bore 14, such embodiments may also be used in one or more lateral well bores drilled of well bore 14 or any other surface well bore. For example, one or more lateral well bores may extend horizontally from well bore 14 and a liner may be inserted through well bore 14 and into one or more of these lateral well bores. The method described above may then be performed relative to such lateral well bores. For example, multiple lateral well bores may be successively cleaned out using such a method.

Although some embodiments of the present invention have been described in detail, various changes and modifications may be suggested to one skilled in the art. It is intended that the present invention encompass such changes and modifications as falling within the scope of the appended claims.

What is claimed is:

1. A method for extracting resources from a subterranean coal bed, comprising:

forming an articulated well bore extending to the subterranean coal bed and coupled to the surface, the articulated well bore having a first diameter and having an open end at the surface and a closed end in the coal bed;

inserting a liner into the well bore, the liner having a wall including a plurality of apertures and a second diameter that is smaller than the first diameter of the articulated well bore;

positioning a tube having an entry end and an exit end into the liner, wherein an annulus is defined between the tube and the liner that is operable to accommodate a fluid flow;

generating a flow of fluid through the annulus from the closed end to the open end of the well bore by urging the fluid into the entry end of the tube and out of the exit end of the tube;

receiving, at the open end of the well bore, a mixture comprising the fluid flowing from the closed end of the well bore, a plurality of coal fines, and coal seam gas that is mixed with the fluid; and separating the coal seam gas from the mixture.

2. The method of claim 1, wherein the fluid is a material selected from a group consisting of coal seam gas, water, air and foam.

3. The method of claim 1, wherein the mixture is a first mixture and the fluid is coal seam gas, and further comprising:

generating a flow of water or foam through the annulus from the closed end to the open end of the well bore by urging water into the entry end of the tube and out of the exit end; and receiving, at the open end of the well bore, a second mixture including water or foam from the closed end of the well bore and any coal fines from the well bore that is mixed with the received second mixture.

4. The method of claim 1, wherein the second diameter of the liner is less than ninety percent of the first diameter of the well bore.

5. The method of claim 1, wherein each of the apertures in the wall of the liner comprises a slot having a width of between 1/32 and 1/2 inches.

6. The method of claim 1, wherein each of the apertures in the wall of the liner comprises a hole having a diameter of between 1/16 and 1.5 inches.

7. The method of claim 1, wherein the closed end is positioned farther below the ground surface than any other part of the well bore.

8. The method of claim 1, and further comprising collapsing the well bore around the liner after inserting the liner.

9. The method of claim 1, wherein the articulated well bore comprises an approximately horizontal drainage portion extending into the closed end of the well bore.

10. A method for extracting resources from a subterranean coal bed, comprising:

forming a drainage well bore in the coal bed, the well bore having a first end coupled to a ground surface and a second end in the coal bed;

inserting a tube into the second end of the drainage well bore;

generating a flow of fluid from the second end to the first end by injecting fluid into the second end through the tube;

after generating the flow, collecting, at the first end, a mixture comprising the fluid, a plurality of coal fines, and any resource from the well bore that is mixed with the fluid;

separating the resources from the mixture; and re-injecting at least a portion of the resources through the second end of the drainge well bore.

11. The method of claim 10, and further comprising:

positioning a liner into the well bore without providing any support for preventing a collapse of the well bore, the liner having a wall defining a plurality of apertures, wherein a space sufficient to allow the well bore to collapse around the liner is defined between the well bore and the liner; and wherein inserting a tube comprises inserting a tube through the liner.

12. The method of claim 11, wherein each of the apertures defined by the wall of the liner comprises a hole having a diameter of between 1/16 and 1.5 inches.

13. The method of claim 11, wherein the well bore has a first diameter and the liner has a second diameter that is at least ten percent smaller than the first diameter.

14. The method of claim 11, wherein the well bore has a first diameter equal to or greater than approximately six inches and the liner has a second diameter equal to or less than approximately five inches.

15. The method of claim 10, wherein the well bore has a diameter equal to or greater than approximately six inches.

16. The method of claim 10, wherein the well bore has a diameter of between approximately five to eight inches.

17. The method of claim 10, wherein the second end of the well bore is positioned farther below the ground surface than the first end.

18. The method of claim 10, wherein the well bore comprises a substantially horizontal drainage portion.

19. A method for extracting resources from a subterranean coal bed, comprising:

forming a drainage well bore in the coal bed, the well bore having a first end coupled to a ground surface and a second end in the coal bed;

inserting a tube into the second end of the drainage well bore;

generating a flow of fluid from the second end to the first end by injecting fluid into the second end through the tube;

after generating the flow, collecting, at the first end, a mixture comprising the fluid, a plurality of coal fines, and any resource from the well bore that is mixed with the fluid;

positioning a liner into the well bore without providing any support for preventing a collapse of the well bore, the liner having a wall defining a plurality of apertures, wherein a space sufficient to allow the well bore to collapse around the liner is defined between the well bore and the liner;

wherein inserting a tube comprises inserting a tube through the liner; and collapsing the well bore around the liner after positioning the liner in the well bore.

20. A method for extracting resources from a subterranean coal bed, comprising:

forming a drainage well bore in the coal bed, the well bore having a first end coupled to a ground surface and a second end in the coal bed;

inserting a tube into the second end of the drainage well bore;

generating a flow of fluid from the second end to the first end by injecting fluid into the second end through the tube;

after generating the flow, collecting, at the first end, a mixture comprising the fluid, a plurality of coal fines, and any resource from the well bore that is mixed with the fluid; and wherein the fluid is coal seam gas and the resource is coal seam gas.

21. The method of claim 20, wherein the mixture is a first mixture, and further comprising:

generating a flow of liquid from the second end to the first end of the well bore by injecting the liquid into the second end through the tube; and collecting a second mixture comprising the liquid from the first end of the well bore and any coal fines from the well bore that is mixed with the second mixture.

22. A method for extracting resource from a subterranean well bore, comprising:

forming a drainage well bore in the subterranean coal bed, the drainage well bore having a first cross-sectional diameter, a first end, and a second end;

positioning a liner in the well bore, the liner having a wall including a plurality of apertures and a second cross-sectional diameter that is at least ten percent smaller than the first cross-sectional diameter;

at the first end, collecting a mixture flowing from the second end, the mixture comprising fluid, a plurality of coal fines, and any resource from the well bore; and collapsing the well bore around the liner after positioning the liner in the well bore.

23. The method of claim 22, wherein each aperture of the wall of the liner comprises a hole having a diameter of between 1/16 and 1.5 inches.

24. The method of claim 22, wherein the first cross sectional diameter is equal to or greater than approximately six inches and the second cross sectional diameter is equal to or less than approximately five inches.

25. The method of claim 22, and further comprising:

after positioning the liner, generating a flow of fluid from the second end of the well bore to the first end of the well bore through the liner.

26. The method of claim 25, wherein the fluid is water.

27. The method of claim 22, wherein the first cross sectional diameter is equal to or greater than approximately six inches and the second cross section is equal to or less than five inches.

28. The method of claim 22, wherein the first cross sectional diameter is between approximately five to eight inches.

29. The method of claim 22, wherein the second end of the well bore is positioned farther below the ground surface than the first end.

30. The method of claim 29, wherein the well bore is angled between zero to forty five degrees from a horizontal plane.

31. The method of claim 22, wherein positioning a liner comprises positioning a liner without providing any support for preventing a collapse of the well bore.

32. A method for extracting resource from a subterranean well bore, comprising:

forming a drainage well bore in the subterranean coal bed, the drainage well bore having a first cross-sectional diameter, a first end, and a second end;

positioning a liner in the well bore, the liner having a wall including a plurality of apertures and a second cross-sectional diameter that is at least ten percent smaller than the first cross-sectional diameter;

at the first end, collecting a mixture flowing from the second end, the mixture comprising fluid, a plurality of coal fines, and any resource from the well bore;

separating the resource from the mixture; and injecting at least a portion of the resource into the second end of the well bore through a tube.

33. A method for extracting resource from a subterranean coal bed, comprising:

forming a drainage well bore in the coal bed, the well bore having a first end coupled to a ground surface and a second end in the coal bed;

collecting a mixture of coal seam gas, water, and any coal fines in the well bore;

extracting the coal seam gas from the mixture; and injecting at least a portion of the extracted coal seam gas into the second end of the drainage well bore.

34. A system for extracting resources from a drainage well bore having a first end and a second end, the second end in a subterranean coal bed, the system comprising:

a tube positioned in the second end of the drainage well bore;

a fluid injector coupled to the tube and operable to generate a flow of fluid from the second end to the first end by injecting fluid into the second end through the tube; and a separator coupled to the fluid injector and the tube, the separator operable to collect, at the first end of the well bore, a mixture comprising the fluid, a plurality of coal fines, and any resource from the well bore that is mixed with the fluid.

35. The system of claim 34, and further comprising:

a liner positioned in the well bore, the liner having a diameter and a wall including a plurality of apertures, wherein the diameter of the liner is sufficiently small to define a space between the liner and the well bore that allows the well bore to collapse around the liner, and the liner is not associated with any support for preventing a collapse of the well bore; and wherein the tube is positioned in the liner.

36. The system of claim 35, wherein each of the apertures defined by the wall of the liner comprises a hole having a diameter of between 1/16 and 1.5 inches.

37. The system of claim 35, wherein the well bore has a first diameter and the diameter of the liner is a second diameter, and wherein the second diameter is at least ten percent smaller than the first diameter.

38. The system of claim 35, wherein the well bore has a first diameter equal to or greater than approximately six inches and the diameter of the liner is equal to or less than approximately five inches.

39. The system of claim 34, wherein the separator is further operable to:

separate the resources from the mixture; and re-inject at least a portion of the resources through the tube and into the second end of the drainage well bore.

40. The system of claim 34, wherein the fluid is coal seam gas and the resource is coal seam gas.

41. A system for extracting resource from a drainage well bore in the subterranean coal bed, the drainage well bore having a first cross-sectional diameter, a first end, and a second end, the system comprising:

a liner positioned in the well bore, the liner having a wall including a plurality of apertures and a second cross-sectional diameter that is at least ten percent smaller than the first cross-sectional diameter;

a tube having an entry end and an exit end positioned in the liner, the exit end operable to be positioned approximately at the second end;

a fluid injector coupled to the entry end of the tube, the fluid injector operable to inject injection fluid into the second end of the well bore through the tube; and a separator coupled to the fluid injector, the separator operable to collect, at the first end of the well bore, a mixture comprising injection fluid, a plurality of coal fines, and any resource from the well bore, the separator further operable to separate the resource from the mixture and send at least a portion of the resource to the fluid injector to be used as injection fluid.

42. The system of claim 41, wherein each aperture of the wall of the liner comprises a hole having a diameter of between 1/16 and 1.5 inches.

43. The system of claim 41, wherein the first cross sectional diameter is equal to or greater than approximately six inches and the second cross sectional diameter is equal to or less than approximately five inches.

44. The system of claim 41, wherein injection fluid comprises water.

45. The system of claim 41, wherein the second cross-sectional diameter is equal to or less than five inches.

46. The system of claim 41, wherein the second cross-sectional diameter is at least twenty percent smaller than the first cross-sectional diameter.

47. The system of claim 41, wherein the liner is not associated with any support configured to prevent a collapse of the well bore around the liner.

48. A method for stimulating production of resources from a coal seam, comprising:

forming a drainage well bore in the coal bed, the well bore having a first end coupled to a ground surface and a second end in the coal seam;

inserting a liner into the well bore, the liner having a wall including a plurality of apertures and a second diameter that is smaller than the first diameter of the drainage well bore such that a gap is formed between the wall of the liner and the well bore;

collapsing the drainage well bore around the liner to relieve stress in the coal seam proximate to the liner.

49. The method of claim 48, wherein the second diameter of the liner is less than ninety percent of the first diameter of the drainage well bore.

50. The method of claim 48, wherein each of the apertures in the wall of the liner comprises a slot having a width of between 1/32 and 1/2 inches.

51. The method of claim 48, wherein each of the apertures in the wall of the liner comprises a hole having a diameter of between 1/16 and 1.5 inches.

52. The method of claim 48, further comprising producing coal seam gas via the liner to the surface along with pieces of coal from the coal seam, the coal seam gas and the pieces of coal being produced from the coal seam to the liner via the apertures in the liner.

53. A method for stimulating production of gas from a coal seam, comprising:

forming a drainage well bore including a substantially horizontal section in a coal seam;

inserting a liner into the drainage well bore; and purposefully collapsing the drainage well bore around the liner.

54. The method of claim 53, further comprising collapsing the drainage well bore by lowering bottom hole pressure in the drainage well bore.

55. The method of claim 53, further comprising leaving drilling fluid in the drainage well bore while inserting the liner into the drainage well bore.

56. The method of claim 55, further comprising pumping or gas lifting the drilling fluid to the surface to instigate collapse of the drainage well bore.

57. The method of claim 53, further comprising initiating collapse by lowering the bottom hole pressure in the drainage well bore below a threshold at which the coal around the drainage well bore collapses.

58. The method of claim 53, further comprising removing drilling fluid from the drainage well bore to initiate collapse of the drainage well bore around the liner.

59. The method of claim 53, further comprising initiating collapse using shock waves in the coal bed.

60. The method of claim 53, further comprising initiating collapse using an explosion.

61. The method of claim 53, wherein the coal bed comprises a low permeability coal.

62. The method of claim 53, wherein collapse is controlled based on down-hole pressure.

63. The method of claim 53, whereby permeability of the coal bed is increased proximate to the liner.

64. The method of claim 53, further comprising forming the drainage well bore by drilling the substantially horizontal section in an over balanced condition.

65. The method of claim 64, wherein a cake is formed on a wall of the drainage well bore during over balanced drilling.

66. The method of claim 53, further comprising collapsing the drainage well bore before production of gas from the well bore begins.

67. The method of claim 53, further comprising collapsing the drainage well bore after production of gas from the well bore begins.

68. The method of claim 53, wherein a diameter of the liner is less than ninety percent of the diameter of the drainage well bore.

69. The method of claim 53, further comprising selecting a diameter of the drainage well bore for collapse based on characteristics of the coal bed.

70. The method of claim 53, wherein the liner comprises a wall including a plurality of apertures.

71. The method of claim 70, wherein the apertures have a diameter between one-sixteenth and one and one-half inches.

72. The method of claim 70, wherein the apertures comprise slots having a width between one thirty-second and one-half of an inch.

73. The method of claim 53, wherein coal collapses by expanding against the liner.

74. The method of claim 53, wherein the coal disintegrates during collapse.

75. A method for producing gas from a coal seam, comprising:

forming a drainage well bore comprising a substantially horizontal section in a coal seam;

inserting a liner into the drainage well bore;

collapsing the drainage well bore around the liner; and wherein diameter of at least part of a drainage well bore is sized for collapse based on characteristics of the coal seam.

76. The method of claim 75, wherein a diameter of the liner is sized based on desired collapse of the coal bed around the liner.

77. the method of claim 75, wherein the diameter of at least part of the drainage well bore is sized based on characteristics of the coal seam and a desired collapse condition.

78. A method, comprising:

determining one or more characteristics of a coal bed;

determining a size of at least part of a well bore to drill in the coal bed such that the well bore may be collapsed by pumping fluids from the well bore to reduce bottom hole pressure before or during production.

79. A method for producing resources from a coal seam, comprising:

forming a substantially horizontal well bore in a coal seam;

inserting a liner into the substantially horizontal well bore;

collapsing the substantially horizontal well bore around the liner; and forming at least one lateral in the coal seam from the substantially horizontal well bore.

80. The method of claim 79, further comprising instigating collapse.

81. The method of claim 79, wherein the substantially horizontal well bore is sloped in the coal seam.

82. A method for producing resources from a coal seam, comprising:

forming a substantially horizontal well bore in a coal seam;

inserting a liner into the substantially horizontal well bore;

collapsing the substantially horizontal well bore around the liner; and producing fluid from the coal seam through the liner and reinjecting at least a portion of the fluid.

83. The method of claim 82, further comprising instigating collapse.

84. The method of claim 82, wherein the substantially horizontal well bore is sloped in the coal seam.

85. A method for producing resources from a coal seam, comprising:

forming a substantially horizontal well bore in a coal seam;

inserting a liner into the substantially horizontal well bore;

collapsing the substantially horizontal well bore around the liner; and injecting a fluid into the liner to remove coal fines.

86. The method of claim 85, further comprising instigating collapse.

87. The method of claim 85, wherein the substantially horizontal well bore is sloped in the coal seam.

88. A method for producing resources from a coal seam, comprising:

forming a substantially horizontal well bore in a coal seam;

inserting a liner into the substantially horizontal well bore;

collapsing the substantially horizontal well bore around the liner; and wherein the substantially horizontal well bore is drilled using low loss drilling fluid.

89. The method of claim 88, further comprising instigating collapse.

90. The method of claim 88, wherein the substantially horizontal well bore is sloped in the coal seam.

* * * * *